US007298994B2

(12) United States Patent
Morgenweck et al.

(10) Patent No.: US 7,298,994 B2
(45) Date of Patent: Nov. 20, 2007

(54) PROCESS AND PRINTING MACHINE FOR THE USE OF LIQUID PRINT COLORS

(75) Inventors: Frank-Michael Morgenweck, Molfsee (DE); Domingo Rohde, Kiel (DE); Detlef Schulze-Hagenest, Molfsee (DE); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 257 days.

(21) Appl. No.: 10/826,734

(22) Filed: Apr. 16, 2004

(65) Prior Publication Data

US 2005/0231582 A1 Oct. 20, 2005

(51) Int. Cl.
*G03G 15/11* (2006.01)

(52) U.S. Cl. ..... 399/251; 347/102

(58) Field of Classification Search ..... 399/249, 399/251, 335, 336; 430/117–119; 347/102, 347/155, 156, 100
See application file for complete search history.

(56) References Cited

U.S. PATENT DOCUMENTS 4,511,778 A * 4/1985 Takahashi et al. ..... 219/691
5,200,285 A * 4/1993 Carrish ..... 430/45
5,563,644 A * 10/1996 Isganitis et al. ..... 347/102
5,757,407 A * 5/1998 Rezanka ..... 347/102
6,122,471 A * 9/2000 Liu et al. ..... 399/237
6,428,161 B1 8/2002 Wotton et al. ..... 347/102
6,683,287 B2 * 1/2004 Behnke et al. ..... 219/678
6,866,378 B2 * 3/2005 Wotton et al. ..... 347/100
2002/0191993 A1 * 12/2002 Bartscher et al. ..... 399/320
2003/0013034 A1 * 1/2003 Behnke et al. ..... 430/124
2003/0231234 A1 12/2003 Ushirogouchi et al. ..... 347/100
2004/0037598 A1 * 2/2004 Behnke et al. ..... 399/336
2004/0048183 A1 * 3/2004 Teshima ..... 430/137.1
2004/0055175 A1 3/2004 Lyle et al. ..... 34/245

FOREIGN PATENT DOCUMENTS

JP 62187856 A * 8/1987

* cited by examiner

*Primary Examiner*—Robert Beatty
(74) *Attorney, Agent, or Firm*—Lawrence P. Kessler

(57) ABSTRACT

Using liquid print color in a printing process in which the print color is transferred from one transfer device onto another transfer device and/or onto a printing medium. To improve handling of the print color, in particular, to optimize it, preferably to avoid adversely affecting transference of the print color and at the same time to avoid adverse effects upon the printing medium, at least one liquid component of the print color is reduced.

17 Claims, 6 Drawing Sheets

PROCESS AND PRINTING MACHINE FOR THE USE OF LIQUID PRINT COLORS

FIELD OF THE INVENTION

The invention pertains to using liquid print colors during a printing process of a printing machine in which the print color is transferred from one transfer device to another transfer device and/or to a printing medium.

BACKGROUND OF THE INVENTION

Different approaches can be used to transfer liquid print color onto a printing medium, particularly, onto paper. In this regard, the term "print color" is used in its broadest sense, particularly, as color for relief print, intaglio printing, or offset printing, but it is also used to describe the ink used in inkjet printing. In the instant case, however, print color can also mean liquid toner, primarily used in electrophotographic printing. In different printing processes several transfer devices can be used sequentially, specifically, in offset printing and in electrophotographic printing, the print color can be transferred onto a print blanket and from a print blanket.

One possible liquid components of the print color is a liquid solvent, in particular, a polar solvent, preferably water, whereas environmentally friendly solvents must be given preference.

Print color in a liquid form promotes the development of the image to be transferred, as well as the transferability and the correct distribution of the print color, but it can also result in smearing or it can cause adverse effects upon, or changes in, the printing medium. This can happen even more severely if the printing medium is absorbent paper.

SUMMARY OF THE INVENTION

This invention is to improve the handling of the print color, specifically, to optimize such handling and preferably, to avoid adversely affecting transference of the print color while avoiding adverse effects upon the printing medium.

This invention is achieved by reducing at least one liquid component of the print color. This can be done by reducing the component either before or after the transfer, or partly before and partly after the transfer. In particular, the reduction can occur right on the printed form after development of the image to be transferred, and/or before or after transfer onto a print blanket, and/or before or after transfer onto a printing medium. The timing will mainly depend upon the selected printing process, the selected printing medium and the characteristics of the print color. Reduction of the liquid component following transfer to the printing medium, especially when the printing medium is paper, should preferably occur immediately after the transfer and before excess capillary action causes the liquid to be absorbed too deeply into the printing medium. In particular, it is beneficially intended that the reduction of the liquid component be sufficient enough to prevent moisture from undesirably affecting the printing medium, while at the same time, maintain the natural moisture content of the printing medium, so that it does not dry out.

The liquid component is reduced, preferably through its warming or heating, for example with the use of microwaves to accomplish this purpose. Irradiation with microwaves has several benefits. To a certain degree, the process is self-regulating, because the microwaves, in particular, are absorbed by water constituents that are already present.

Thus, the greater the constituency, the more effective the heating. In addition, heating with microwaves is both thorough and volume related. For microwave irradiation, at least one resonator is preferred to generate standing microwaves specifically, resonators, of the type TE10N or TE101 may be used.

In addition, provision can be made according to the invention for increasing the capacity of the print color, and/or a liquid component, to absorb microwaves. This can be done by the use of various measures. It should be mentioned, in particular, that the absorption capacity of the print color can be raised by the use of an additive that has an enhanced capacity to absorb microwaves, that the capacity of the print color can be raised by admixing a liquid component that has an enhanced capacity to absorb microwaves, that the admixture or blending can occur azeotropically, i.e., by constant boiling, that an admixture or blend is formed of at least two liquid components having unlike phases, of which at least one liquid component has an enhanced capacity to absorb microwaves, and that one of the liquid components may be emulsified into the other liquid component and/or that the emulsification is supported or promoted by at least one additive.

In addition, or as an alternative to directly heating the print color, the printing medium itself can be heated. Other developments according to the invention provide for at least one physical parameter to be controlled or regulated as a function of a parameter that is correlated with the energy input into the printing medium onto which print color has been transferred. Thus, the invention does not utilize the application of a simple, flat standard, but rather of variable standards based upon the actual, preferably measured, circumstances.

In this regard the aforementioned energy input can correspond essentially to the amount of the microwave output that is absorbed by the entire system, which includes both the printing medium and the print color, so that according to the invention, the output energy can be compared with, and adjusted to, the absorbed energy in accordance with the actual prevailing circumstances. This in turn is consistent with efficiency control and/or adjustment. In this regard consideration can be given to controlling the transmission in the broadest sense of the word and/or the receiving system itself, which includes the color print and the printing medium, or the handling of the receiving system.

In this regard the invention proposes in detail, regulation of the microwave emitter and/or regulation of the printing medium's speed of travel, and/or adjustment of the resonator, and/or adjustment of the frequency of the microwaves. The last two measures would preferably also be used to achieve higher energy absorption directly in the print color in order to more precisely influence its fusion than would be possible to do indirectly and more problematically via the printing medium.

In terms of a measurable parameter to be used to guide the dependent regulation, the invention proposes preferentially that either the temperature of the printing medium be used, or the microwave energy that is reflected from, and thus not absorbed by, the print color/printing medium system be used. Other measurable parameters, without limit, could be the weight, the thickness, or the water content of the printing medium.

Preferably, at least two resonators will be required for the microwaves in order to assure homogeneous heating of the print color. These should be offset from one another by $\lambda/4$ in order to offset the maxima of the standing waves in the resonators correspondingly.

A further development of the invention provides in lieu of this approach for the use of only one resonator that oscillates fully or partially. Another further development of the invention provides that whenever more than two resonators are used, the resonators be offset from one another by a length λ divided by twice the number of resonators. This results in a more even distribution of temperature on the substratum than is achievable when the offset is λ/4. In a preferred embodiment of the invention four resonators are used each of which is offset from the next by λ/8.

In principle all of the frequencies in the microwave range from 100 MHz to 100 GHz can be used. Customarily the ISM frequencies approved for industrial, scientific, and medicinal use, preferably 2.45 GHz, are used. However, use of other frequencies within the above-mentioned broad frequency range can advantageously result in the absorption of a greater percentage of radiation energy.

In particular, the mechanism for such reduction of at least one liquid component of the print color can be installed upstream of, downstream of, or both upstream and downstream of a transfer device. The reduction mechanism incorporates advantageously a heating mechanism, in particular, a microwave irradiator, preferably at least one resonator for generating standing microwaves.

A further development of the mechanism according to the invention, is characterized by at least one resonator for microwaves transmitted from the emitter (microwave source), which generates a standing microwave that is approximately perpendicular to the plane of the printing medium.

A resonator that is installed vertically in this manner has the advantage that it distributes the intensity of its electromagnetic field particularly favorably in the plane of the printing medium. That is to say, across an appropriately limited resonator width a very homogeneous intensity of the electromagnetic field is generated in the plane of the printing medium and at right angles to its direction of travel such that the printing medium and the print color on the printing medium are evenly heated across this width, and also along the length of the printing medium, provided the printing medium is being evenly transported along its direction of travel. Thus, with a resonator according to the invention, a band that is as wide as the resonator itself can be heated sequentially and evenly over the length of the printing medium.

A succeeding further development of the invention provides for the use of more than one resonator, whereby the resonators are installed across the width of the printing medium such that the effective widths of the neighboring resonators necessarily and advantageously overlap so that the printing medium and the print color on the printing medium are evenly, completely, and gaplessly heated over the entire surface of the printing medium. And in this process, as already mentioned, care is taken that the resonator delivers the most homogenous electromagnetic field possible, which can be readily assured in a resonator width of up to about 20 cm, whereby a resonator width of about 4 cm to about 8 cm is preferred.

The resonators should preferably be installed in staggered formation, whereby different formations are possible. For example, the resonators could be installed in two rows one behind the other with spaces between them, which would produce a compact, space-saving arrangement. However, the resonators could also be arranged in a step formation or in a V formation. These formations have the advantage that the toner in the overlapping areas of the resonators' working widths does not cool off between passes of the sequentially installed resonators. This, in turn, prevents the possibility of a buildup of a visible boundary layer that could be caused by repeated heating of the print color in the overlapping areas. In addition, the aforementioned formations offer the advantage that sufficient space remains available for the elements that transport the printing medium in the area of the mechanism according to the invention.

In principle all resonators in use can be fed by a single microwave source. In this process the energy can, for example, be distributed to the individual systems by T pieces.

A homogeneous heating of the image that is to be fused can be more reliably assured if each resonator is fed by its own microwave source. Thus, an uneven heating of the image that is to be fused, which is caused by the resonators' dissimilar levels of microwave dispersion, can be compensated by adjusting the microwave energy for each resonator, whereby the microwave energy is adjusted to match the resonator's level of microwave dispersion.

Nevertheless, a reasonable minimization of the number of microwave sources can sometimes be achieved in that the output of a single microwave generator is distributed to two resonators by T pieces, whereby it is preferably to assure that the two resonators have approximately the same level of microwave dispersion. For example, in a row consisting of four resonators, which are installed across the width of a printing medium, the two middle resonators and the two outer resonators could always be operated in conjunction with one another, such that a symmetrical level of microwave dispersion would always exist with reference to a symmetrical axis running between the two inner resonators. In this way, the number of microwave sources or magnetrons can be reduced by half.

In the plane that divides each resonator and through which the printing medium is transported, thus making it the printing medium plane, no, or only a few, cross currents flow on the resonator chamber's inner wall so that no high level of scattered radiation occurs. In order to establish electrical contact between a resonator's divided areas (half shells) a suitable conductive connector can be used. Of course, connectors can, from the standpoint of geometry, be difficult to create, if several resonators are installed next to one another. It can therefore make sense to establish the electrical contact by connectors that are suitably connected to one another. Such interconnecting will not influence the individual resonators. In this process one may need to take care that contact points of branch connections are located at places at which a high current density exists inside of the resonator.

Independently adjusting the individual resonators for maximal absorption could lead in some circumstances to unsatisfactory results. Reduction results could be uneven. Therefore, in order to obtain an even result the absorption of the printing medium could be optimized in the sequentially following resonators while the previous resonators are turned on.

In addition, the radiation scatter that exits from the pass through openings of the resonator may be reduced by constructing so-called chokes and/or by the use of absorbent materials outside the resonator.

The use of at least one resonator which is about 1 to about 20 cm long in the printing medium's direction of travel can be preferred in order to simplify handling the printing medium, but also to make possible a sufficient output (for example, 1 to 10 KW per resonator) without resulting arcing. In this process the width of the resonator should also be matched with the printing medium's speed of travel. What is involved here is a relative speed (for example, up to 100 cm/s), such that the heating mechanism itself could be moved relative to a resting printing medium, or both could move. It is even conceivable that the heating could be accomplished in a completely static environment.

This invention is for use preferably with a digital, multicolor printing machine.

The invention, and its objects and advantages, will become more apparent in the detailed description of the preferred embodiment presented below.

BRIEF DESCRIPTION OF THE DRAWINGS

In the detailed description of embodiments of the invention presented below from which further characteristics according to the invention can result, to which however the invention is not limited, are shown in the accompanying drawings. The drawings are as follows.

DETAILED DESCRIPTION OF THE INVENTION

Figure 1:
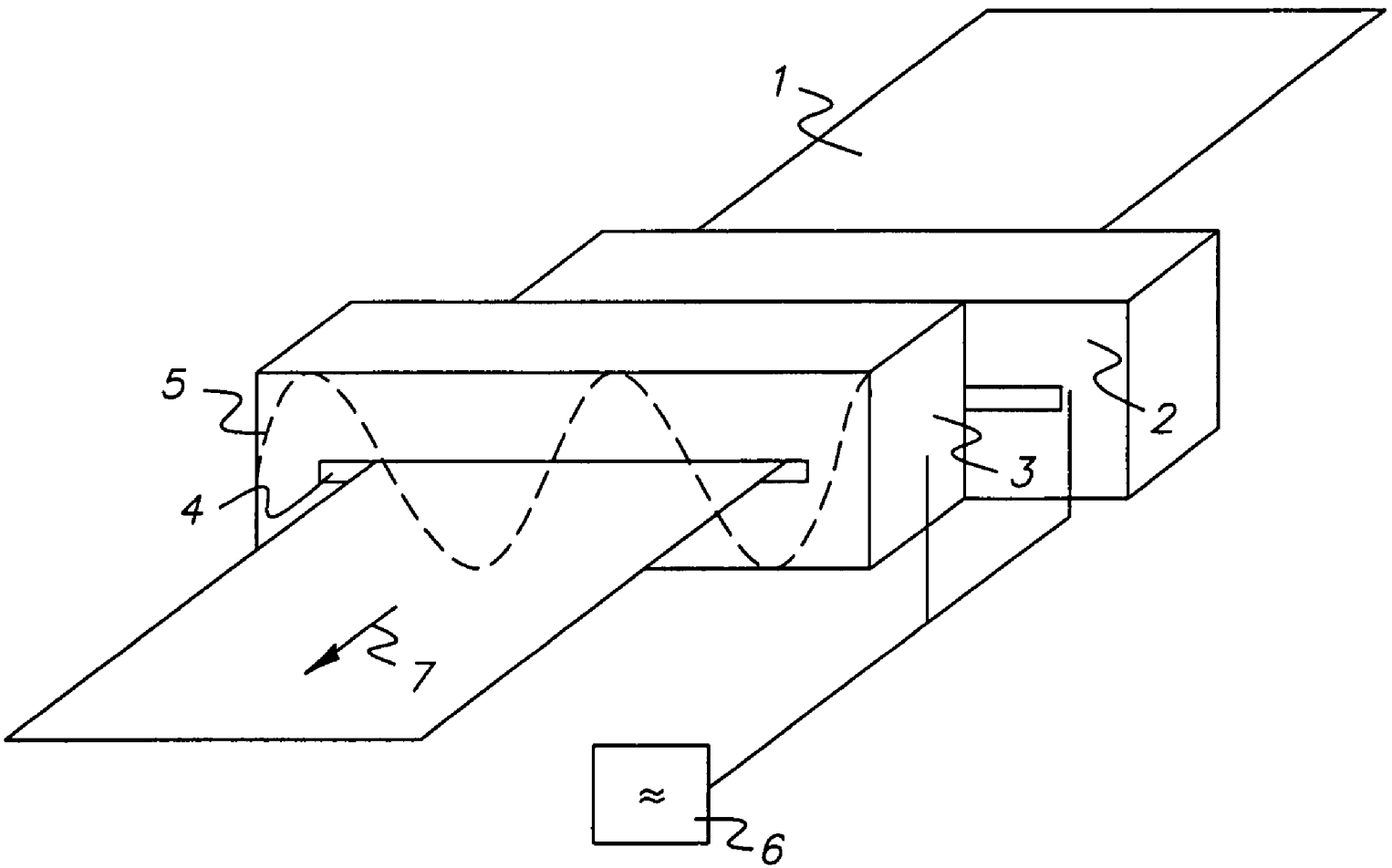
FIG. 1 shows a schematic view of an embodiment of a mechanism according to the invention that is for heating a printed image.

Referring now to the accompanying drawings:

FIG. 1 shows schematically, and only as an example, a view of a possible embodiment of a mechanism according to the invention that is to heat a printed image, in particular, for the implementation of the process according to the invention. FIG. 1 shows a section of a conveyor belt 1 on which sheets of sheet-shaped printing medium can be placed one after the other and then transported. This conveyor belt 1 passes through a heating mechanism that includes, among other things, two resonators 2 and 3 that are offset one from the other. The resonators have, in a suitable location, a slit 4, which is approximately 3 mm to 10 mm high and through which the conveyor belt and the printing medium pass.

As indicated in FIG. 1, standing microwaves 5 are formed in the resonators 2 and 3, from which field strength maxima are found in the plane of the conveyor belt 1 or in that of the printing medium located thereon and which heat, in particular, the printing medium and the printed image located thereon so that a liquid component of the image's print color is reduced. As can be seen in FIG. 1 the resonators 2 and 3 are installed such that they are offset from one another by one-quarter of the wave length of the microwaves 5 in order to achieve a corresponding offset of the maxima of the microwave 5 and to heat the printing medium and the image relatively evenly. It should be noted that the wave length of this microwave 5, which will hereinafter be identified by the λ sign and which corresponds to the course of energy input into the printing medium, corresponds to only half the wave length of the original, free microwave that was fed through a wave guide.

For the purpose of forming a microwave field, resonators 2 and 3 are connected via wave guides (represented in the drawing by lines) to a suitable system for generating microwaves 6. The conveyor belt 1 and the printing medium located thereon move through the resonators 2 and 3 in the direction of the arrow 7 at a speed, for example, of up to one meter per second. The radiation scatter that exits through the pass through openings of the resonators can be reduced by a so-called choke and/or by the use of absorbent materials located outside the resonators.

Figure 2:
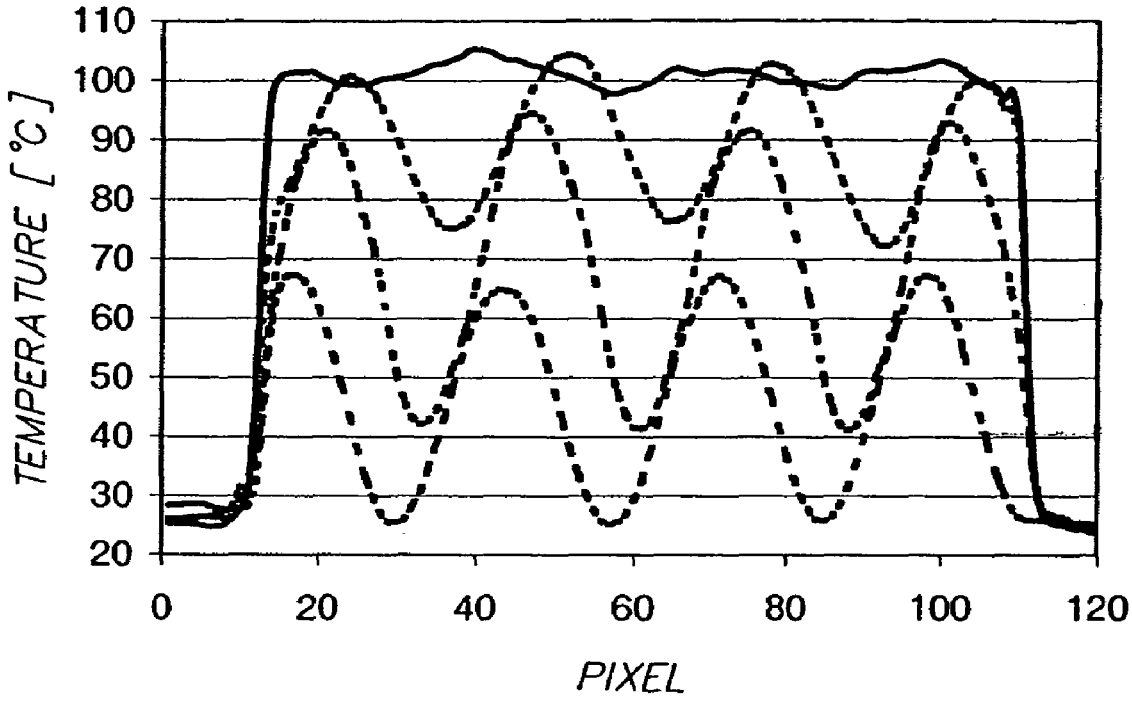
FIG. 2 shows the temperature distribution of a sheet of paper, the measurement having been made by a Bartec R2610 line pyrometer immediately after the sheet of paper left the resonators, and whereby the temperature curve across the width of the paper is shown with first one resonator turned on, then the first two resonators, then the first three resonators and then all four resonators and where the pixel size is approximately 3 mm.

FIG. 2 makes it clear that the offset arrangement of the standing microwaves or the courses of the field strengths when four resonators are used leads advantageously to particularly even heating of the printing medium. FIG. 2 shows temperature curves for the printing medium across the width of the printing medium (analyzed or measured in terms of pixels) in degrees Celsius (° C.), the first of which when only one resonator is in use, the second of which when two resonators are in use, the third of which when a combination of three resonators are in use, and the fourth of which when four resonators are in use. The last temperature curve in the series is recognizably even across the width of the substratum at approximately 100° C.

Figure 3:
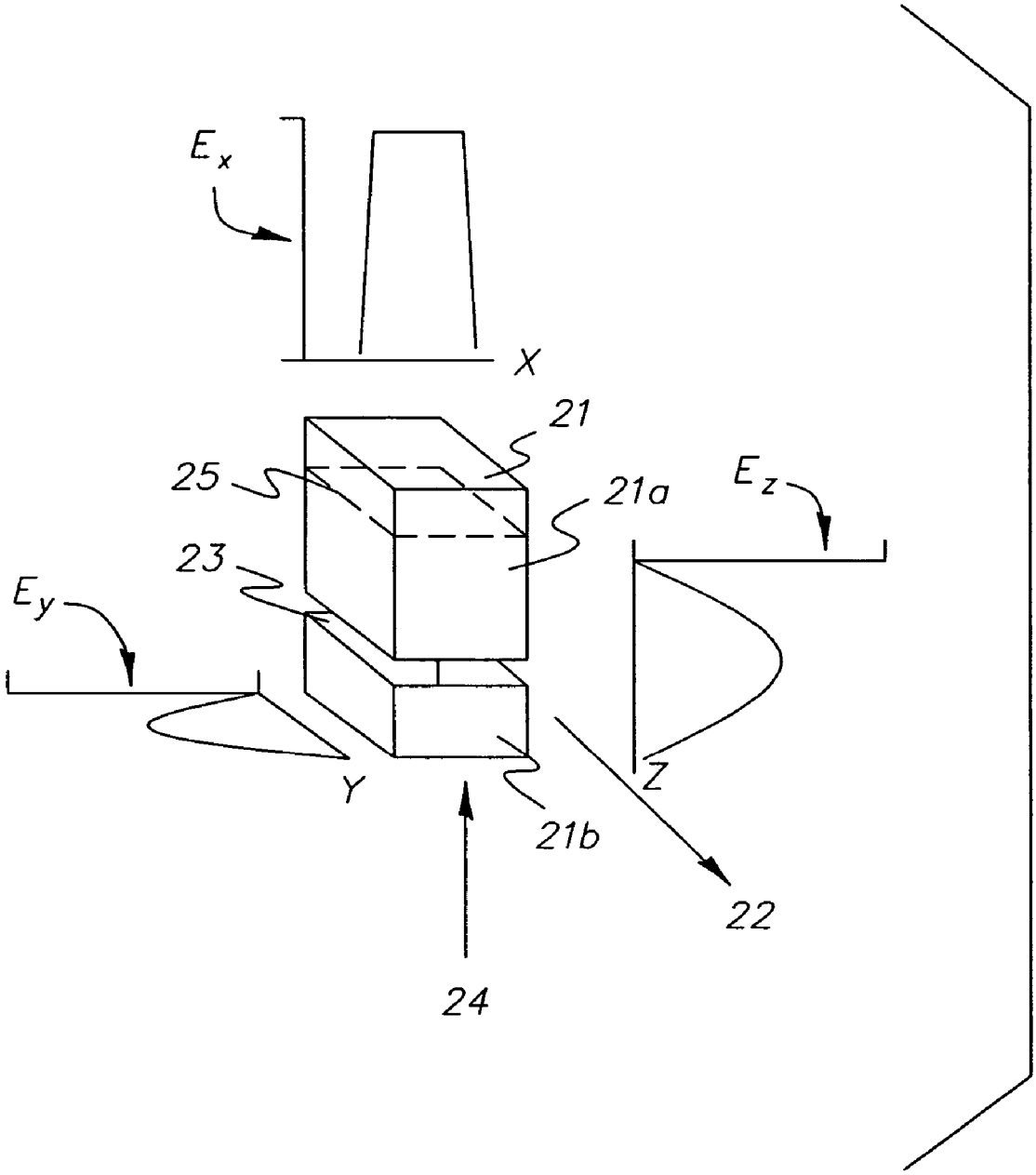
FIG. 3 shows a schematic view of another embodiment of a resonator according to the invention that is used to heat a printed image.

FIG. 3 shows a schematic view of a resonator 21 that, in accordance with the invention, is installed perpendicular to the plane of conveyance of a printing medium which is not shown in this drawing, but which is conveyed in the direction shown by the arrow 22 through a dividing slot 23 of the resonator 21. The resonator 21 is divided into two parts 21*a* and 21*b* by the dividing slot, which simultaneously defines the plane of conveyance of the printing medium. Microwaves can be fed into the resonator 21 in the direction shown by the arrow 24 from a microwave source that is not shown, whereby a moveable stop valve 25 is indicated in the resonator part 21*a*.

Around the resonator in FIG. 3, a coordinate system with an x, y, and z axis is shown, with the use of which the orientation of resonator 21 is to be shown. The direction of travel 22 of the printing medium coincides with the y axis, the width of the printing medium runs in the direction of the x axis, and the direction of excitation of the standing wave in the resonator 21 runs perpendicularly in the direction of the z axis.

The intensities $E_x$, $E_y$, and $E_z$ of the components of the resonator's electromagnetic field are qualitatively plotted along the axes of the coordinate system, which are each a function of the particular coordinate. It thus turns out that the curve showing the intensity of the electromagnetic field $E_x$ in the direction of the x axis, therefore in the direction of the width of the printing medium, is almost square, which means that this intensity is essentially constant, i.e., homogeneous, across the width of the resonator 21. This results in the printing medium on which the print color is located being heated in proportion to the distribution of intensity, that is, the printing medium is homogeneously heated during its travel in the direction of travel 22 across the x width of the resonator 21. In this regard, of course, the x width of the resonator 21 is limited by the fact that the field distribution changes if the spread is too great. The result of this could be that the heating profile in the x direction would no longer be homogeneous. Consequently, the x width of the resonators 21 should be limited to less than 20 cm, and should preferably be about 4 cm to 8 cm.

Consequently, for the purpose of covering the entire x width of the printing medium, it is necessary to install several resonators that are distributed across the width of the printing medium. In addition, a staggered arrangement of the resonators 21 offers the advantage that the resonators can be arranged such that there is enough room between them for the emplacement of elements needed to convey the printing medium. In this way the printing medium can be kept in physical contact with the means of conveyance. This, in turn, assures a secure conveyance.

Figure 4:
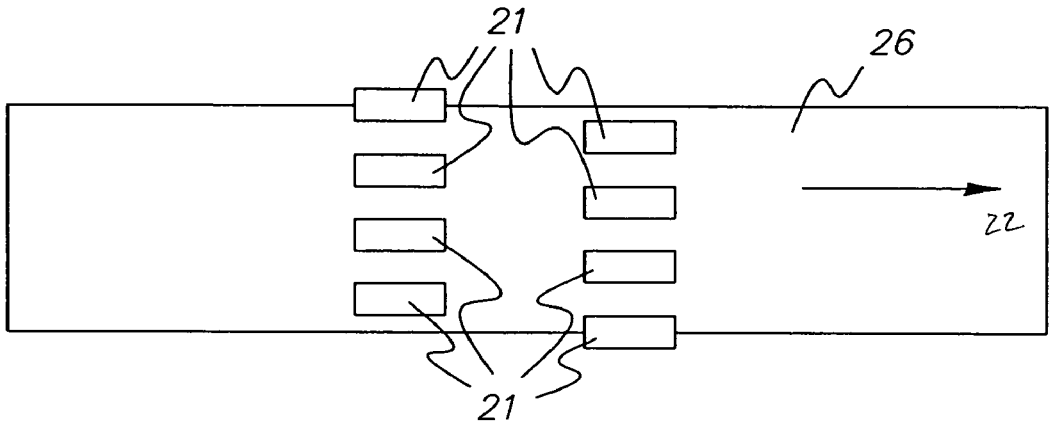
FIG. 4 shows an overhead view of a two-row arrangement of eight resonators of a mechanism according to the invention, which is used to heat a printed image.
Figure 5:
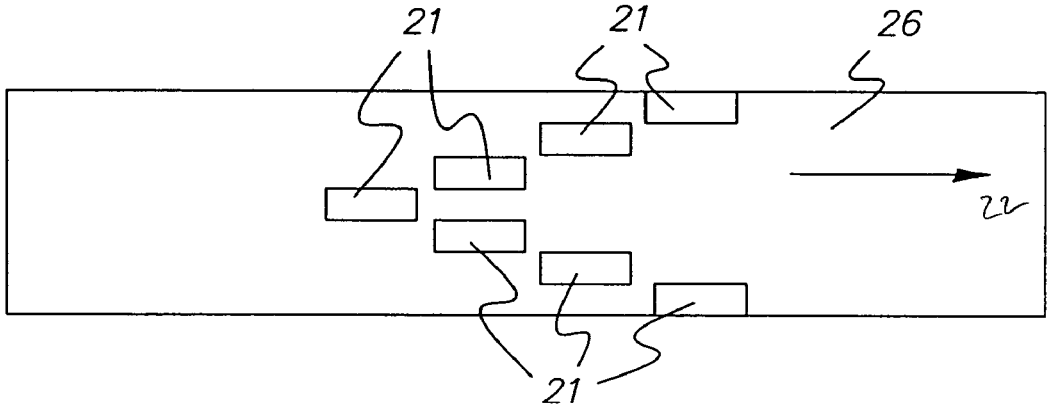
FIG. 5 shows an overhead view of an arrangement of seven resonators, arranged in a V formation.
Figure 6:
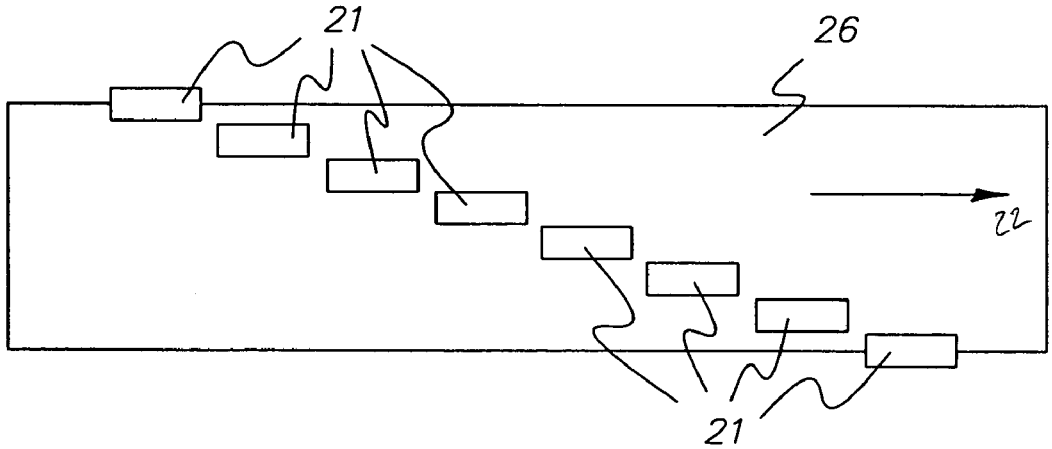
FIG. 6 shows an overhead view of an additional staggered arrangement of eight resonators of a mechanism according to the invention that is used to heat a printed image.

FIGS. 4 through 6 each shows a schematic overhead view of a preferred arrangement of resonators 21 that are to heat a printing medium homogeneously across its entire width. A conveyor belt 26 is indicated under the represented work areas of the resonators; the conveyor belt moves in the direction of travel shown by the arrow 22 and it is for the purpose of conveying the printing medium and to carry it through the dividing slot 23 of the resonators 21.

FIG. 4 shows a particularly compact arrangement. The resonators 21 are located in rows of four and sequentially in columns of two relative to the direction of travel 22, whereby each of the resonators 21 is arranged to cover a gap. In FIG. 5 the resonators 21 are staggered one behind the other in a V formation, whereby here, too, the resonators 21 as a group cover the entire width of the conveyor belt 26. In FIG. 6 the resonators are staggered in steps one behind the other, and once again they cover the entire width of the conveyor belt as a group.

In the three drawings, FIGS. 4 through 6, the longitudinal edges of the resonators 21, which following one after the other, always cover the next section of the overall width of the conveyor belt 26, each of which is in alignment with the others. It is, however, better in terms of homogeneous heating of the printing medium when the effective widths of the resonators 21 and the effective areas that are swept by them overlap one another. Such an overlapping area can advantageously be 1 mm to 300 mm wide, but preferably 1 mm to 10 mm. The preferred number of resonators 21 can then be a function of the width of an individual resonator 21, the size of the overlapping area, and the width of the printing medium or the conveyor belt 26. For example, using the arrangement shown in FIG. 4 for a sheet of paper (the printing medium) that is maximally 383 mm wide, 8 resonators can be installed in two rows of four resonators 21 each. Each of these resonators can have an effective width of 54 mm at a right angle to the direction of travel. The two rows of resonators 21 can be at a distance of 525 mm from each other in the direction of travel 22. The resonators 21 in the two rows can be arranged at right angles to he direction of travel so as to cover gaps, i.e., they can be offset from one another by 47 mm. Taking the given effective width into consideration the effective widths of the resonators 21 that run sequentially in the direction 22 will then overlap by 7 mm.

The arrangements shown in FIGS. 5 and 6 have the additional advantage that the print color does not become cold in the overlapping areas of the resonators 21 during the transition from the effective area of one resonator to that of the next resonator 21 as the printing medium is being further conveyed in the direction of travel 22. Thus the possible formation of a visible boundary layer caused by renewed heating in the overlapping areas of the resonators 21 can be avoided. The arrangements shown in FIGS. 5 and 6 are also optimized to the effect that only a minimal surface is not in contact with the printing medium's means of conveyance.

Figure 7:
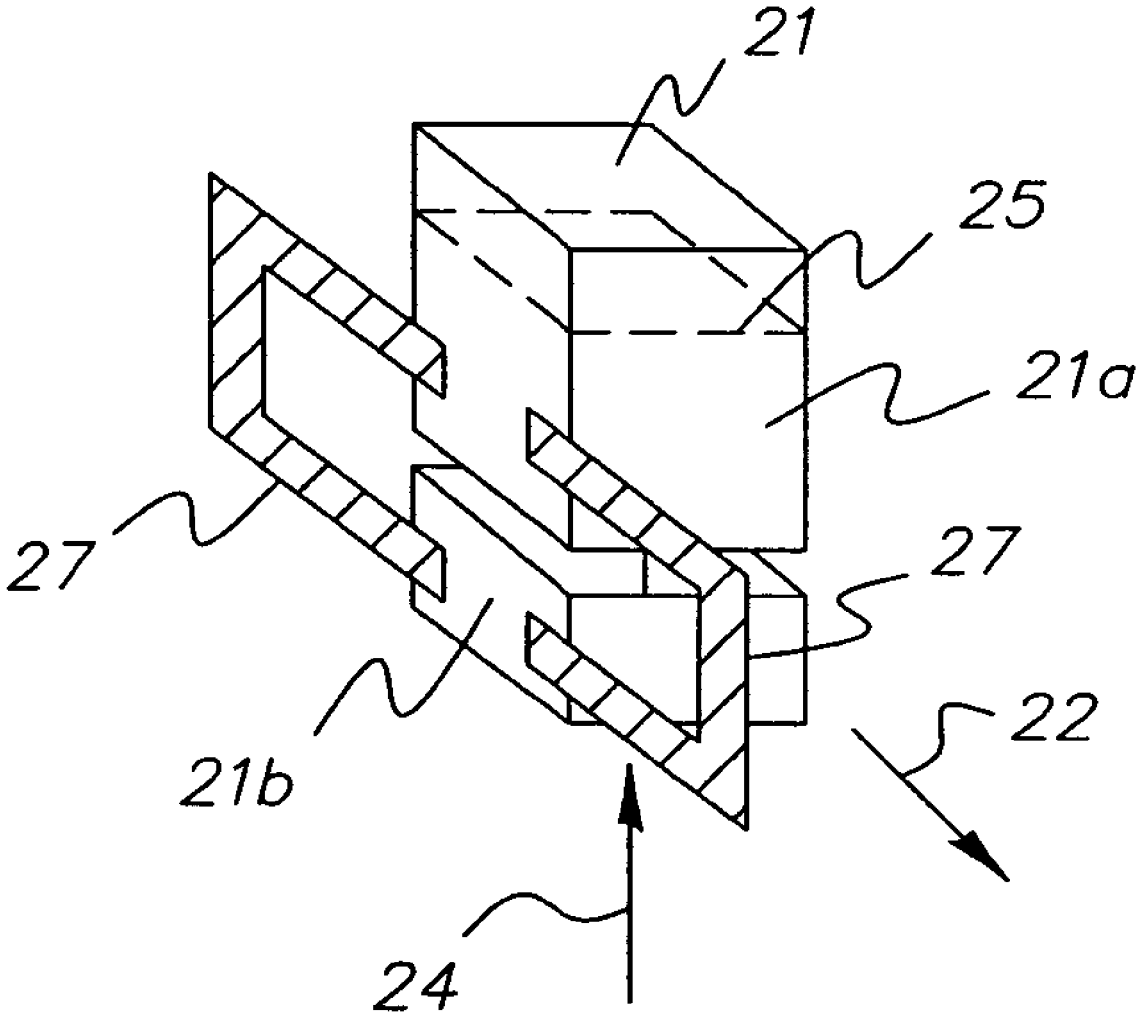
FIG. 7 shows a view of a resonator like the one in FIG. 3 along with connectors.

FIG. 7 once again shows a schematic view of the resonator 21 that is shown in FIG. 3, but now with an electrically conductive connecting element 27 that is used to connect part 21*a* and part 21*b* of the resonator 21. This provides the electrical connection between the resonator parts 21*a* and 21*b* so that equalizing currents can flow.

Figure 8:
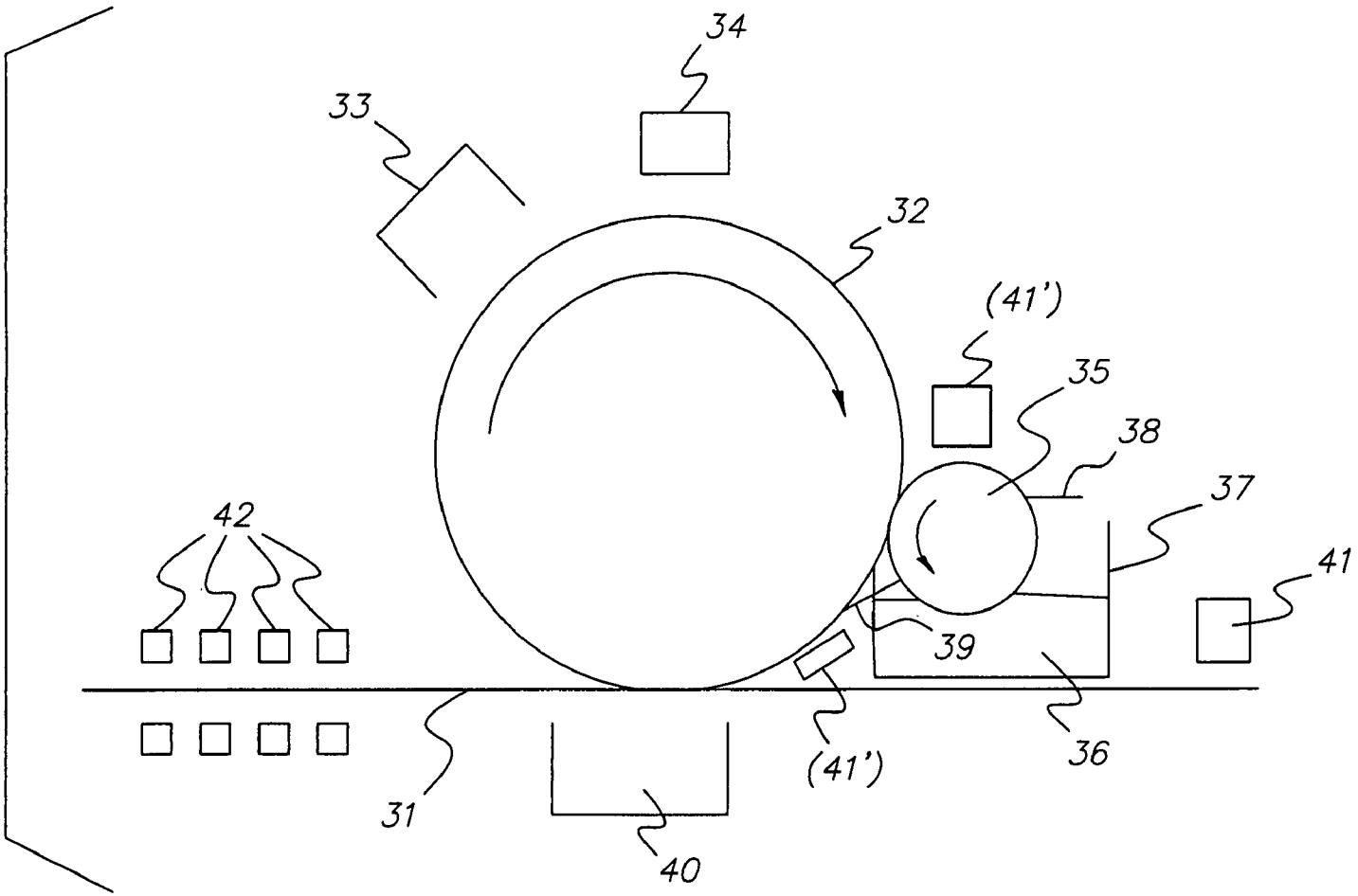
FIG. 8 shows a schematic side view of an imaging mechanism of an electrophotographic printing machine.

FIG. 8 shows a schematic side view of an imaging mechanism of an electrophotographic printing machine that incorporates at least one heating mechanism according to the invention. The imaging mechanism follows the concept found in the disclosure of U.S. Pat. No. 5,561,507. In principle the process according to the invention could naturally be implemented using printing machines that are equipped or retrofitted in accordance with the invention, in particular, with other printing machines that operate electrophotographically, for example, in accordance with U.S. Pat. No. 5,752,142 or PCT Application No. WO 01/92968.

In the mechanism shown in FIG. 8 a printing medium 31, which can be either in sheet or roll form, is indicated; this printing medium passes an imaging cylinder 32 of a printing machine which, acting as a transfer device, directly transfers a printed image onto the printing medium 31. For this purpose the imaging cylinder 32 is evenly charged or discharged by a first corona 33. Subsequently an image is placed on the imaging cylinder 32 by an exposure unit 34, which selectively either charges or discharges a photo sensitive layer on the imaging cylinder 32 corresponding to the printed image information, depending upon whether the first corona 33 charged or discharged the imaging cylinder 32. With the aid of an application roller 35, which can also be referred to as a transfer device, liquid toner 36 from a tank 37 is transferred to the imaging cylinder 32, whereby this toner 36 selectively adheres to the imaging cylinder 32 commensurate with the imaging previously accomplished with the exposure unit 34, and the image that is to be transferred is developed in this way. The application and transfer of the toner 36 are controlled with the aid of wipers 38 and 39. The transfer of the print image from the imaging cylinder 32 to the printing medium is then accomplished with the aid of a second corona 40 that is located under the printing medium.

Heating mechanisms 41 and/or 42 according to the invention can be mounted at different locations where they will be used to reduce the liquid component of the liquid toner 36 on the imaging cylinder 32 after the print image has been developed, on the application roller 35 before the liquid toner 36 is transferred to the imaging cylinder 32, and/or on the printing medium after the print image has been transferred. In location 41 the printing medium 31 can also be preheated for this purpose even before the print image has been accepted.

As examples only, resonators like those shown in FIG. 1 are indicated at location 42, while resonators like those shown in FIG. 3 are indicated at location 41. Such a use is, of course, optional.

The invention has been described in detail with particular reference to certain preferred embodiments thereof, but it will be understood that variations and modifications can be effected within the spirit and scope of the invention.

What is claimed is:

1. A process for using liquid print color in a printing process in which the print color is transferred from one transfer device onto another transfer device and/or onto a printing medium, comprising the step of: reducing at least one liquid component of the print color by heating the print color by irradiation with standing microwaves which are generated by at least one resonator, absorption capacity of the print color being raised by an admixture, accomplished azeotropically, of a liquid component with a high absorption capacity for microwaves, wherein the admixture is accomplished with at least two liquid components of unlike phases, of which at least one liquid component has a high absorption capacity for microwaves.

2. A process according to claim 1, wherein the reducing step occurs before the transfer.

3. A process according to claim 1, wherein the reducing step occurs after the transfer.

4. A process according to claim 1, wherein the reducing step occurs in part before and in part after the transfer.

5. A process according to claim 1, wherein the absorption capacity of the print color is raised by using an additive with a high absorption capacity for microwaves.

6. A process according to claim 1, wherein one of the liquid components is emulsified into the other liquid component.

7. A process according to claim 6, wherein the emulsification is supported or promoted by at least one additive.

8. A process according to claim 1, wherein the printing medium is heated.

9. A process according to claim 1, wherein at least one physical process parameter of the irradiation with microwaves is controlled or regulated as a function of a parameter that is correlated with the energy input into the printing medium onto which print color has been transferred.

10. A process according to claim 9, wherein the output of the microwave emitter is regulated as a function of the energy input, such that when the energy input is too low the output is raised and when the energy input is too high the output is lowered so that on average an essentially constant, suitable energy input is maintained.

11. A process according to claim 10, wherein the speed of the printing medium's travel through an area being irradiated with microwaves is regulated as a function of energy input such that when the energy input is too low the printing medium is fused at a lower speed and when the energy input is too high the printing medium is fused at a higher speed.

12. A process according to claim 9, wherein the microwave emitter is adjusted as a function of energy input.

13. A process according to claim 9, wherein the temperature of the printing medium is used as the parameter to be correlated with the energy input.

14. A process according to claim 9, wherein the efficiency of the energy input is used as the parameter to be correlated with the energy input.

15. A process according to claim 9, wherein standing microwaves are used which are generated by at least one resonator, and the reflected power or energy of the resonator containing either partially or wholly a printing medium is measured as the parameter to be correlated with the energy input and is then compared with the output from the microwave emitter.

16. A process according to claim 15, wherein in a microwave frequency range between 100 MHz and 100 GHz a frequency is selected which is outside of the approved ISM frequencies and which in a ratio of microwave energy absorbed by the toner to the total microwave energy absorbed favors increased microwave energy absorbed by the toner.

17. A process according to claim 16, wherein a resonator for the microwaves is used which oscillates partially or completely with a component of movement that is perpendicular to the direction of travel of the printing medium that is passing through the area being irradiated with microwaves.

* * * * *